US011805366B2

(12) United States Patent
Xiao et al.

(10) Patent No.: US 11,805,366 B2
(45) Date of Patent: Oct. 31, 2023

(54) MULTIFUNCTIONAL ELECTROMAGNETIC TRANSDUCER

(71) Applicant: AAC Microtech (Changzhou) Co., Ltd., Changzhou (CN)

(72) Inventors: Bo Xiao, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 71 days.

(21) Appl. No.: 17/566,710

(22) Filed: Dec. 31, 2021

(65) Prior Publication Data

US 2023/0145438 A1 May 11, 2023

(30) Foreign Application Priority Data

Nov. 10, 2021 (CN) ..... 202111327612.8

(51) Int. Cl.

| | |
|---|---|
| ***H04R 9/02*** | (2006.01) |
| ***H04R 1/02*** | (2006.01) |
| ***H04R 9/06*** | (2006.01) |
| ***H04R 31/00*** | (2006.01) |

(52) U.S. Cl.

CPC ..... *H04R 9/025* (2013.01); *H04R 1/026* (2013.01); *H04R 9/06* (2013.01); *H04R 31/006* (2013.01); *H04R 2400/07* (2013.01)

(58) Field of Classification Search

CPC ..... H04R 9/06; H04R 29/001; H04R 7/10; H04R 3/007; H04R 2499/11; H04R 9/025; H04R 1/026; H04R 1/025; H04R 31/006; H04R 2400/07

See application file for complete search history.

(56) References Cited

U.S. PATENT DOCUMENTS

| | | | | |
|---|---|---|---|---|
| 6,735,322 | B1 * | 5/2004 | Watanabe | H04R 9/041 381/404 |
| 2020/0213748 | A1 * | 7/2020 | Liu | H04R 9/06 |
| 2020/0413199 | A1 * | 12/2020 | Song | H04R 9/06 |
| 2021/0274289 | A1 * | 9/2021 | Wang | H04R 1/2834 |

* cited by examiner

*Primary Examiner* — Carolyn R Edwards
*Assistant Examiner* — Julie X Dang
(74) *Attorney, Agent, or Firm* — W&G Law Group

(57) ABSTRACT

The present invention provides a multifunctional electromagnetic transducer including: a housing providing with an accommodation space; a speaker received in the accommodation space, the speaker including: a first vibration system with a voice diaphragm, and a first magnetic circuit system fixed to the housing driving the voice diaphragm to vibrate along a first direction and generate sounds; a vibrator received in the accommodation space driving the multifunctional electromagnetic transducer to vibrate along a second direction, the vibrator including: a second vibration system with a vibration diaphragm, and a second magnetic circuit system flexible suspending on the housing driving the voice diaphragm to vibrate; wherein the voice diaphragm, the voice diaphragm and a housing enclosed a rear chamber.

8 Claims, 6 Drawing Sheets

261

MULTIFUNCTIONAL ELECTROMAGNETIC TRANSDUCER

FIELD OF THE PRESENT INVENTION

The present invention relates to an electromagnetic transducer, and more particularly, to a multifunctional electromagnetic transducer.

DESCRIPTION OF RELATED ART

The speaker in the related art can only produce sound by driving the voice diaphragm, and the speaker can't achieve a high performance of bass effect due to the insufficient driving force.

Furthermore, the vibration feedback and the voice feedback of the electronic device are respectively completed by different devices, which is not conducive to the reduction of the volume of the electronic device. Even a multifunctional sounding device that integrates different functions requires a long time for vibration response, and the user experience is not good.

Therefore, it is desired to provide a new multifunctional electromagnetic transducer which can overcome the above problems.

SUMMARY

In view of the above, the embodiment of the present invention provides a new multifunctional electromagnetic transducer. By the present invention, the multifunctional electromagnetic transducer can achieve a better bass performance.

The present invention provides A multifunctional electromagnetic transducer, including: a housing providing with an accommodation space; a speaker received in the accommodation space, the speaker including: a first vibration system with a voice diaphragm, and a first magnetic circuit system fixed to the housing driving the voice diaphragm to vibrate along a first direction and generate sounds; a vibrator received in the accommodation space driving the multifunctional electromagnetic transducer to vibrate along a second direction, the vibrator including: a second vibration system with a vibration diaphragm, and a second magnetic circuit system flexible suspending on the housing driving the voice diaphragm to vibrate; wherein the voice diaphragm, the voice diaphragm and a housing enclosed a rear chamber.

Further, wherein the first magnetic circuit system includes a first magnetic gap while the first vibration system includes a first coil located in the magnet gap; a connection support connecting the diaphragm and the first coil, and an elastic diaphragm flexible supporting the first coil.

Further, wherein the connection support includes a first bending portion, a connection portion bending and extending from the first bending portion along the first direction and, a second bending portion bending and extending from the connection portion along a direction perpendicular to the first direction.

Further, wherein the vibrator further includes a flexible support fixed to the housing, while the second magnets circuit system is flexible suspend on the housing by the flexible support.

Further, wherein the second magnetic circuit system further includes a second magnetic assembly and a second lower plate supporting the second magnetic assembly, the second lower plate includes a main portion supporting the second magnetic assembly and an extending portion bending and extending from the main portion to the flexible support, wherein the extending portion is fixed to the flexible support.

Further, wherein the flexible support includes a fixing portion fixed to the housing and a flexible arm flexible connecting to the fixing portion which is fixed to the extending portion.

Further, wherein the extending portion includes a third bending portion extending from both ends of the main portion to the flexible support and, a fourth bending portion extending from the third bending portion which is fixed to the flexible arm.

Further, wherein the first magnetic circuit includes a first main magnet and a plurality of auxiliary magnets arranged on the both sides of the first main magnet, the first main magnet spaced apart from the first main magnet for forming the first magnetic gap, the first magnetic circuit further includes a first upper plate, a second lower plate and a first magnetic assembly sandwiched between the first upper plate and the second lower plate.

Further, wherein the first direction forms an angle against the second direction.

Further, wherein the angle is 0° or 90°.

BRIEF DESCRIPTION OF THE DRAWINGS

The exemplary embodiment can be better understood with reference to the following drawing. The components in the drawing are not necessarily drawn to scale, the emphasis instead being placed upon clearly illustrating the principles of the present invention. Moreover, in the drawings, like reference numerals designate corresponding parts throughout the several views.

DETAILED DESCRIPTION OF THE EXEMPLARY EMBODIMENT

Figure 1:
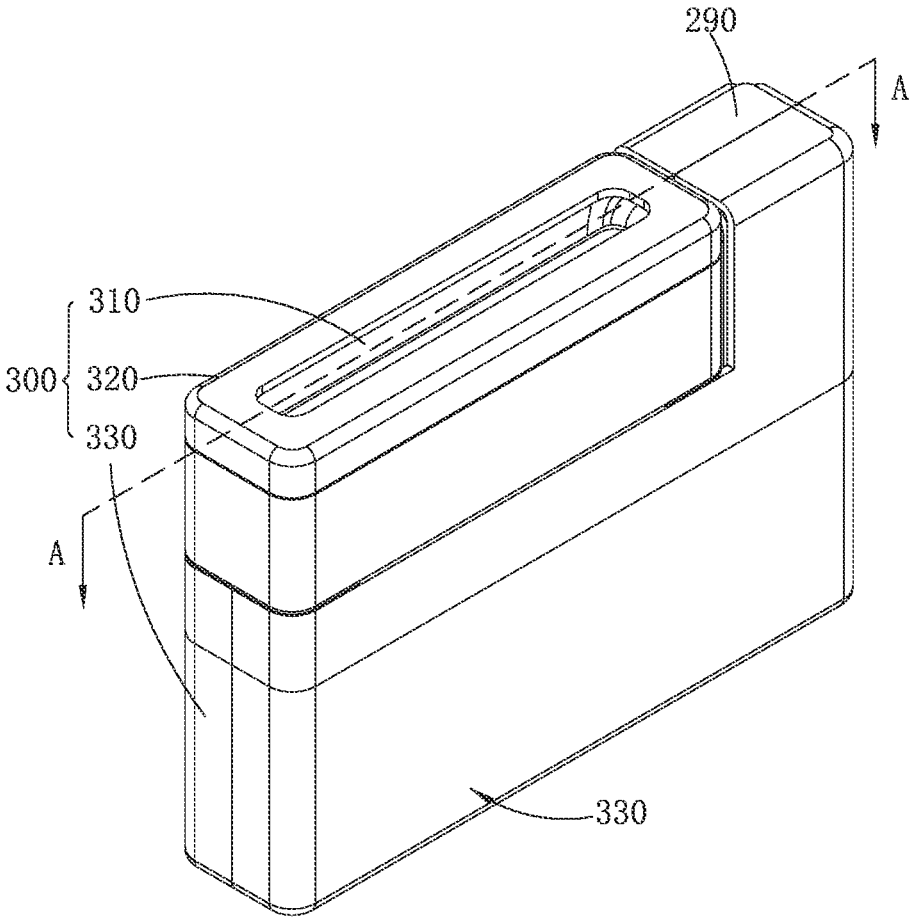
FIG. 1 is an illustrative isometric view of a multifunctional electromagnetic transducer in accordance with the present invention.

The present invention will hereinafter be described in detail with reference to exemplary embodiment. To make the technical problems to be solved, technical solutions and beneficial effects of the present invention more apparent, the present invention is described in further detail together with the figures and the embodiments. It should be understood the specific embodiments described hereby is only to explain the disclosure, not intended to limit the disclosure.

Referring to FIGS. 1 to 5, this example of new practical application of multi-function sounder includes the single emitting unit 100, and the vibrating unit 200, and the housing 300, and the sound emitting unit 100, and the vibrating unit 200 housed in the housing 300, and the housing 300 providing with a sounding hole 310 communicating with the outside. In some optional methods, housing 300 includes the first housing 320 and the second housing 330, and single emitting unit 100 set in the first housing 320. The sound emitting unit 100 is provided in the first housing 320 and is partially exposed to the outside through the sound emitting hole 310 provided on the first housing 330, and vibrating unit 200 is placed in the second housing 330. The sound emitting unit 100 includes a first magnetic circuit system 130 and a first vibration system 120 with a sound film 110. The first magnetic circuit system 130 drives the first vibration system 120 to vibrate and emit sound in a first direction. The system 130 is fixed in the first housing 320. The vibration unit 200 drives the multifunctional sound emitting device to vibrate in the second direction. The vibration unit 200 includes a second vibration system 220 with a diaphragm 210 and a second magnetic circuit system 230. The second magnetic circuit system 230 drives the diaphragm 210 along the first direction. It vibrates in two directions, and the vibration unit 200 can also generate vibration feedback through the vibration of the second magnetic circuit system 230 in the second direction. The sound emitting unit 100 is placed on the side of the second housing 3, which is close to the diaphragm 210; the diaphragm 210 is enclosed with the sound diaphragm 110 and the inner wall of the housing 300 to form a rear cavity 400. It can push the gas in the rear cavity 400 to move and then drive the sound diaphragm 110 of the sound unit 100 to vibrate, when the diaphragm 210 vibrates, providing additional driving force for the sound unit 100. The technical solution of the present invention provides additional driving force through the vibration action of the diaphragm 210 of the vibrating unit 200, thereby providing a stronger driving force for the vibration of the sound diaphragm 110 and increasing the vibration amplitude of the sound diaphragm 110. It can be seen from the above that the technical solution of the present invention acts on the sound film 110 in the same direction through the driving force provided by the first magnetic circuit system 130 and the additional driving force provided by the vibrating unit 200 to provide strong vibration for the sound film 110 driving force, which ensures that the multi-function sound device has lower f0 bass characteristics.

Figure 2:
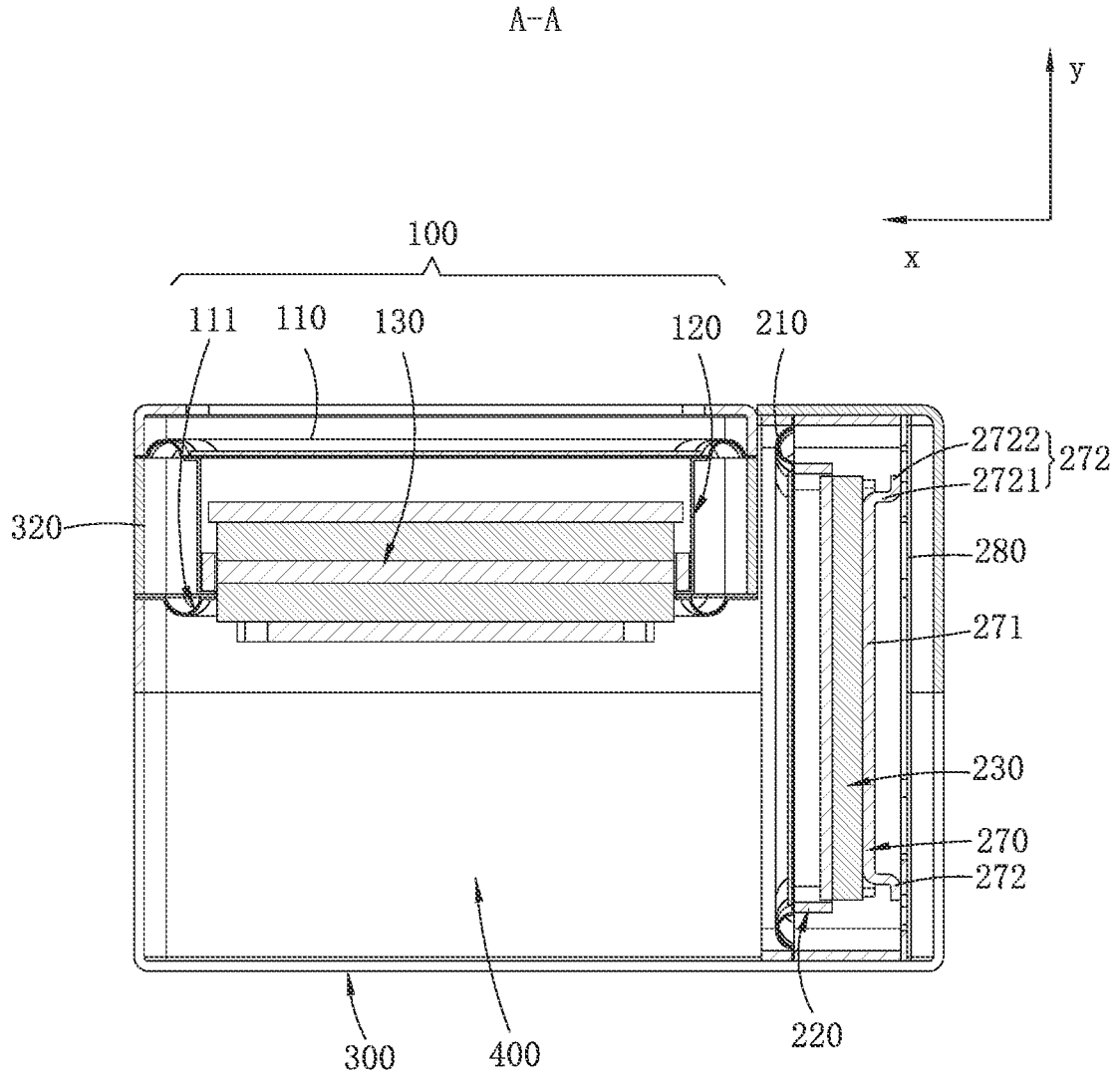
FIG. 2 is an illustrative cross-sectional view of the multifunctional electromagnetic transducer taken along line A-A of FIG. 1.

In some optional embodiments, refer to FIG. 2, the first magnetic circuit system 130 of single emitting unit 100 includes the first splint 131, the first magnetic steel part 132 and the first lower splint 133. The first magnetic steel part 132 is placed between the first upper splint 131 and the first lower splint 132. The first magnetic steel part 132 includes the first main magnetic steel 132*a* and is placed on the auxiliary magnetic steel, which is on the two sides of main magnetic steel 132*a*, forming a gap between the first main magnetic steel 132*a* and the first auxiliary magnetic steel.

The first vibration system 120 includes a first voice coil 140, a sound film 110, a frame 150 and an auxiliary sound film 111 that all inserted in the first magnetic gap. The frame 150 is connected to the sound film 110, the auxiliary sound film 111 and the first voice coil 140. The movement of the first voice coil 140 drives the skeleton 150 to drive the sound membrane 110 and the auxiliary sound membrane 111 to move. The arrangement of the auxiliary sound film 111 is used to suppress the lateral swing of the first voice coil 140 to obtain a better sound effect.

In some optional embodiments, the skeleton 150 includes the first bending part 151, which is vertical to the first direction, and connection part 152 and the second bending part. Connection part 152 is used to connect the first bending part 151 and the second bending part 152. The connection part 152 is respectively vertical to the first bending part 151 and the seconding bending part 153. In details, in some optional embodiments, the first bending part 151 is a sheet-like structure with a flat surface, the second bending part 153 is an arc-shaped columnar structure retracted from both sides to the middle, and the second bending part 153 is an arc-shaped groove-like structure.

In some optional methods, the first direction and the second direction are arranged at an angle or overlapped. Specifically, the first direction and the second direction are arranged perpendicular to each other, so that the longitudinal dimension of the multifunctional sounding device is small and the external shape is regular. On the one hand, it facilitates the installation of the multifunctional sounding device and other parts, and on the other hand, it is convenient for storage and transportation.

In some optional embodiments, the vibration direction of the single emitting unit 100 and the vibration direction of the sound film 110 are perpendicular to each other. More specifically, in the direction indicated by the arrow in FIG. 2, the first direction is the y direction, and the second direction is the x direction.

Furthermore, the practical new type multifunctional sounder has two working modes at least. Under one working mode, it connects the multifunctional sound-emitting device with high-frequency current, so that the multi-functional sound-emitting device exhibits the functional characteristics of a speaker. In another working mode, it connects the multi-functional sound-emitting device with low-frequency current, so that the multi-functional sound-generating device exhibits the functional characteristics of the vibration motor. Therefore, the practical new type multifunctional sounder has the functional characteristics of a speaker and a vibration motor at least in different time periods.

Figure 3:
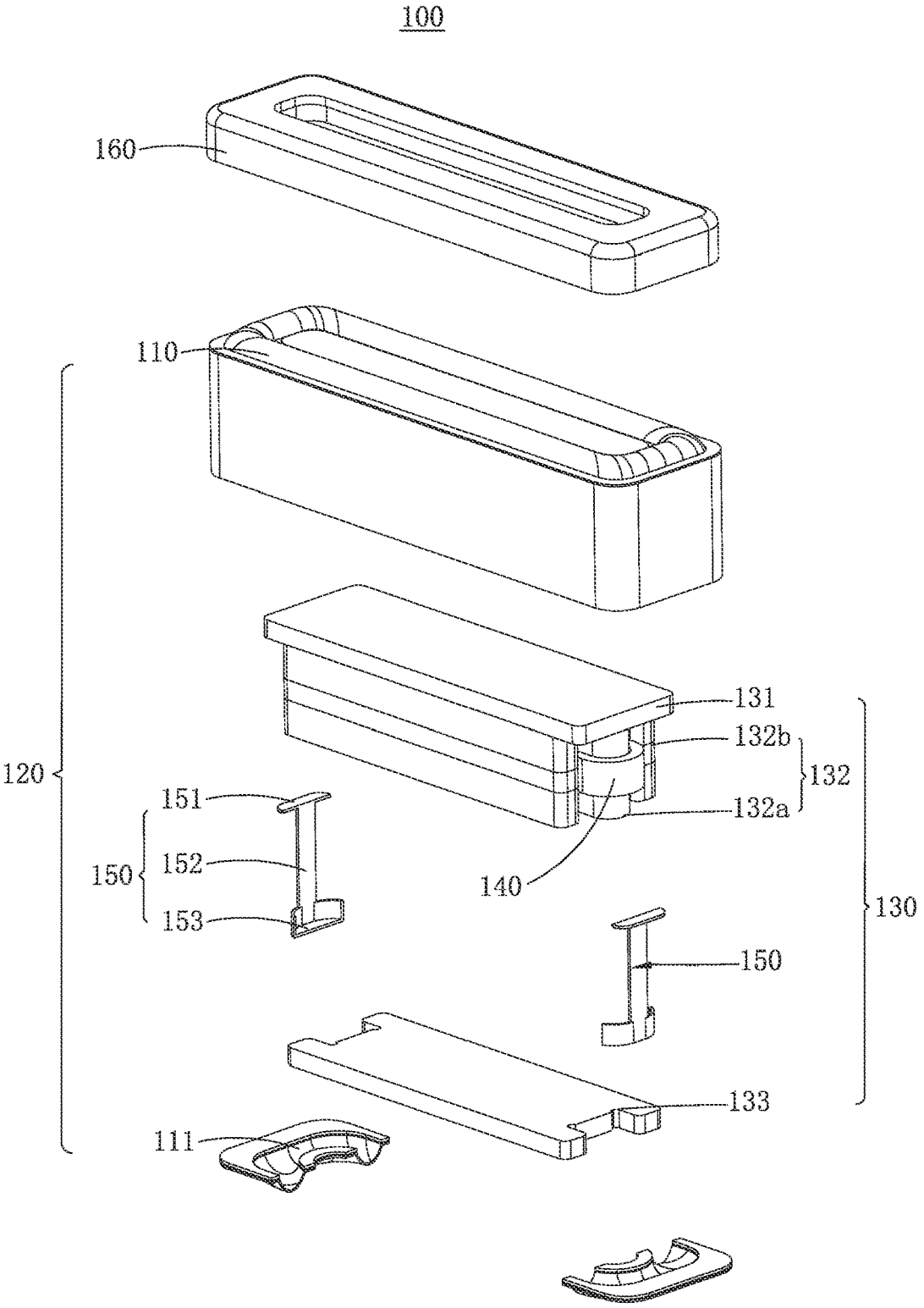
FIG. 3 is an illustrative isometric view of a speaker of the multifunctional electromagnetic transducer in the FIG. 1.
Figure 4:
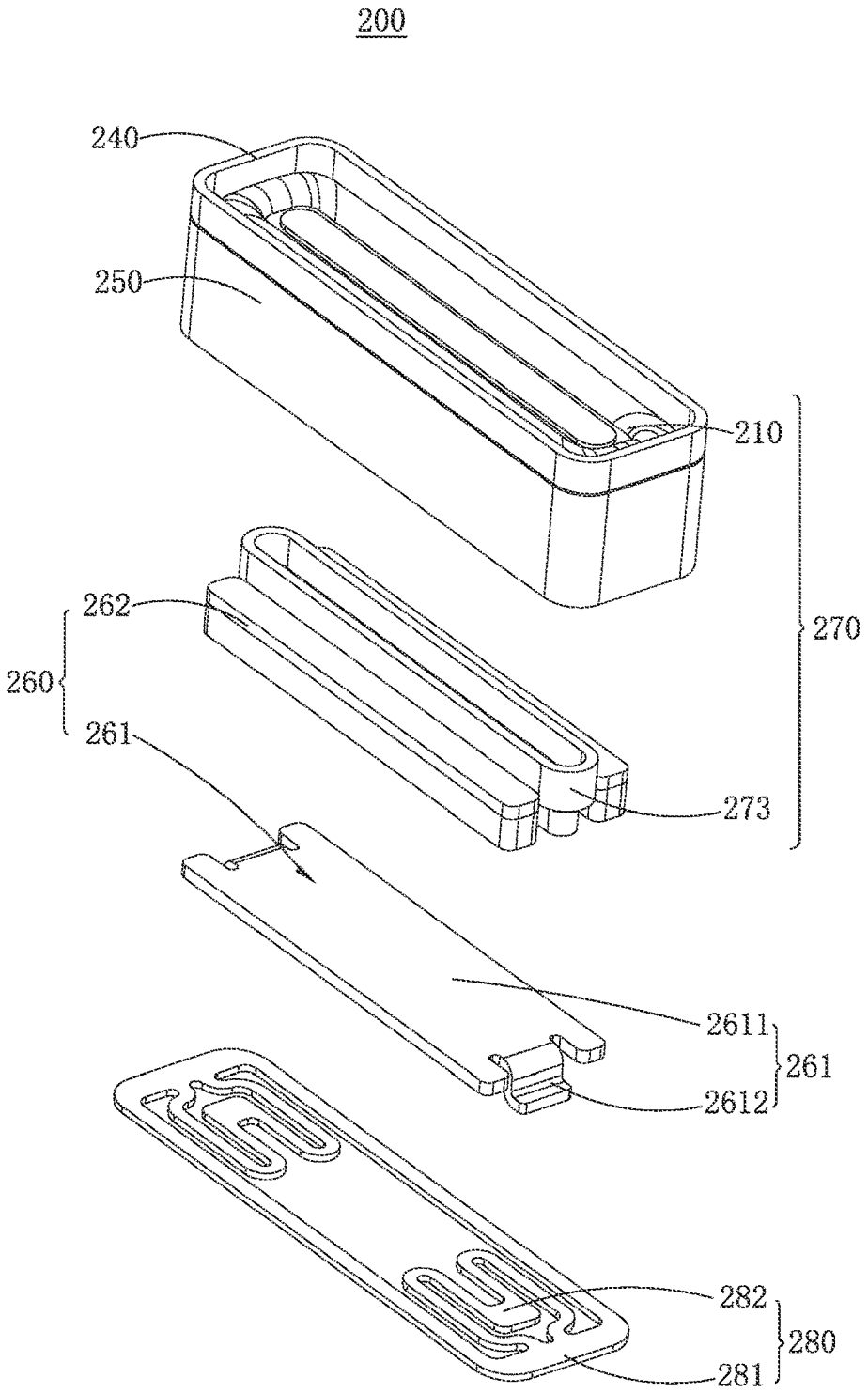
FIG. 4 is an illustrative isometric view of a vibrator of the multifunctional electromagnetic transducer in the FIG. 1.
Figure 5:
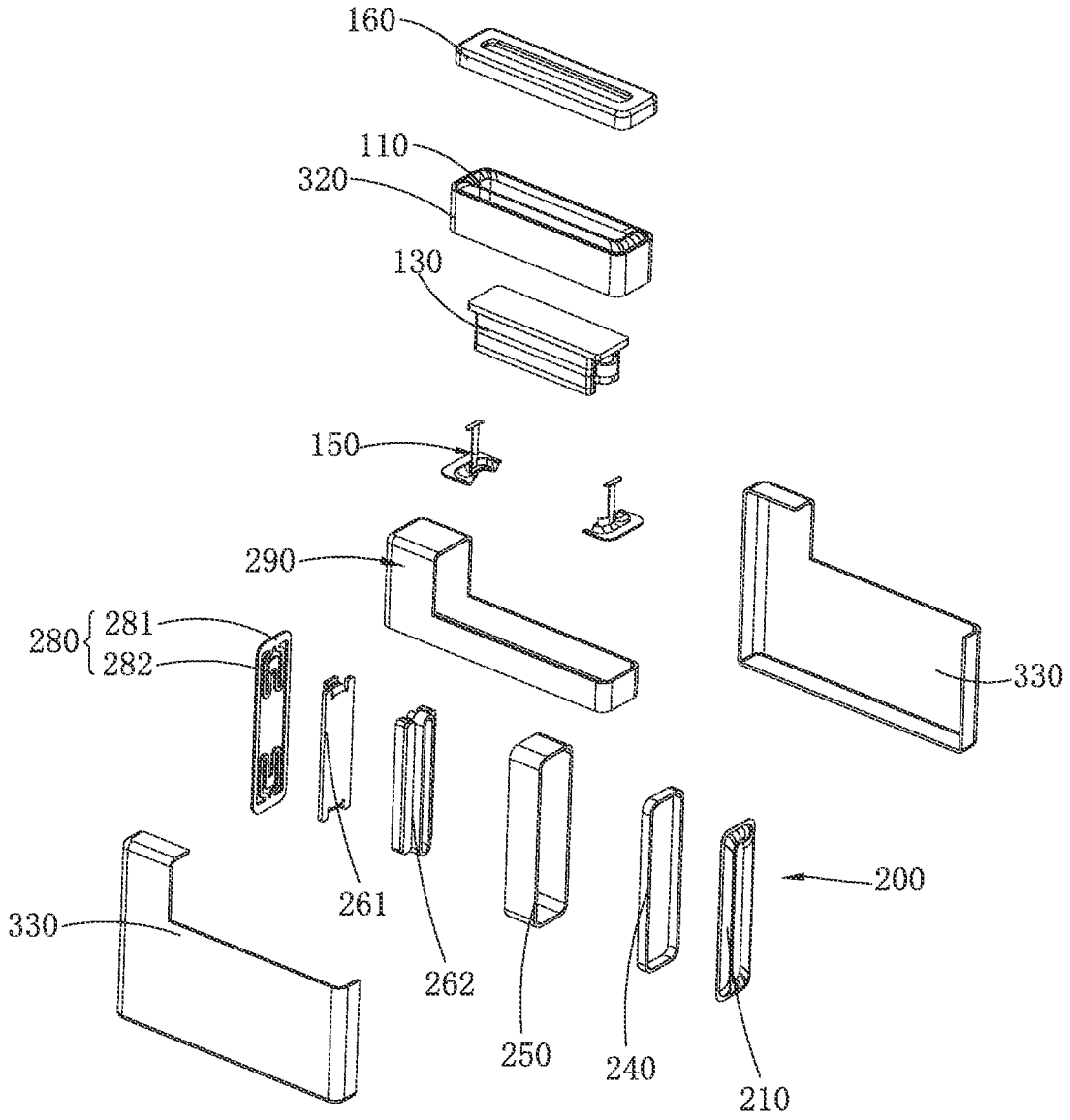
FIG. 5 is an exploded view of the multifunctional electromagnetic transducer in the FIG. 1.

In some optional embodiments, referring to FIG. 3, the vibrating unit 200 includes a top cover 240 and a basin frame 250, a second magnetic circuit system 260, a second vibration system 270, and a shrapnel bracket 280. The shrapnel bracket 280 is fixedly connected to the housing 300. The second magnetic circuit system 260 is suspended in the housing 300 through the shrapnel bracket 280. The second vibration system 270 is connected to the second magnetic circuit system 260, and the second vibration system 270 is driven to vibrate through the second magnetic circuit system 260. The second magnetic circuit system 260 is suspended in the housing 300 through the shrapnel bracket 280. When the second vibration system 270 vibrates, the second magnetic circuit system 260 can follow the vibration at the same time, thereby enhancing the vibration experience of the vibration unit 200. The top cover 240 and the diaphragm 210 is connected. The diaphragm 210 is connected with the basin frame 250, and the basin frame 250 is connected with the housing 300.

The second magnetic circuit system 260 includes a second lower clamping plate 261 and a second magnetic steel assembly 262 carried on the second lower clamping plate 261. The second lower clamping plate 261 includes a main body 2611 for carrying the second magnetic circuit system 230 and a extensions 2612 extending from both sides of the main body portion 2611 to the side close to the elastic sheet support 280, and the extension portions 2612 abut against the elastic sheet support 280, so that the connection between the second lower splint 261 and the elastic sheet support 280 is more stable.

The second vibration system 270 includes a diaphragm 210 and a second coil 273 placed on the second magnetic steel component 262. The second coil 273 is connected to the diaphragm 210, and the second coil 273 is driven to move through the second magnetic circuit system 260. The second coil 273 drives the diaphragm 210 to move.

Furthermore, the setting of the shrapnel bracket 280 provides extra driving force for the vibration of the diaphragm 210, and under the combined action of the second magnetic circuit system 230 and the shrapnel bracket 280, it provides the diaphragm 210 with stronger driving force and faster responding speed. Furthermore, it also provides a stronger driving force for the vibration of the sound film 110. In general, the arrangement of the shrapnel bracket 280 enables the practical new type multifunctional sounder to have a faster response speed and a better user experience in both the speaker function characteristics and the function characteristics of the vibration motor.

In some optional embodiments, the shrapnel bracket 280 includes a fixing part 281 and an elastic arm 282. The fixing part 281 is fixed to the housing 300, and the elastic arm 282 is elastically connected to the extension portion 2612. Specifically, in some embodiments, the shrapnel bracket 280 is a ring-shaped structure with a hollow center as a whole, and the fixing part 281 is a rectangular ring. The hollow-out shrapnel bracket 280 on the one hand can reduce the weight of the shrapnel bracket 280 and reduce the processing materials. On the other hand, a set of opposite sides connecting the shrapnel bracket 280 and the second lower splint 261 extends inwardly with a concave-shaped elastic arm 282. The concave-shaped elastic arm 282 abuts against the second lower clamping plate 261, so that the second magnetic circuit system 260 is suspended in the housing 300, making the vibrating unit 200 generates vibration feedback. At the same time, the "concave"-shaped elastic arm 282 extending inward can also enhance the elastic performance of the elastic sheet bracket 280.

Figure 6:
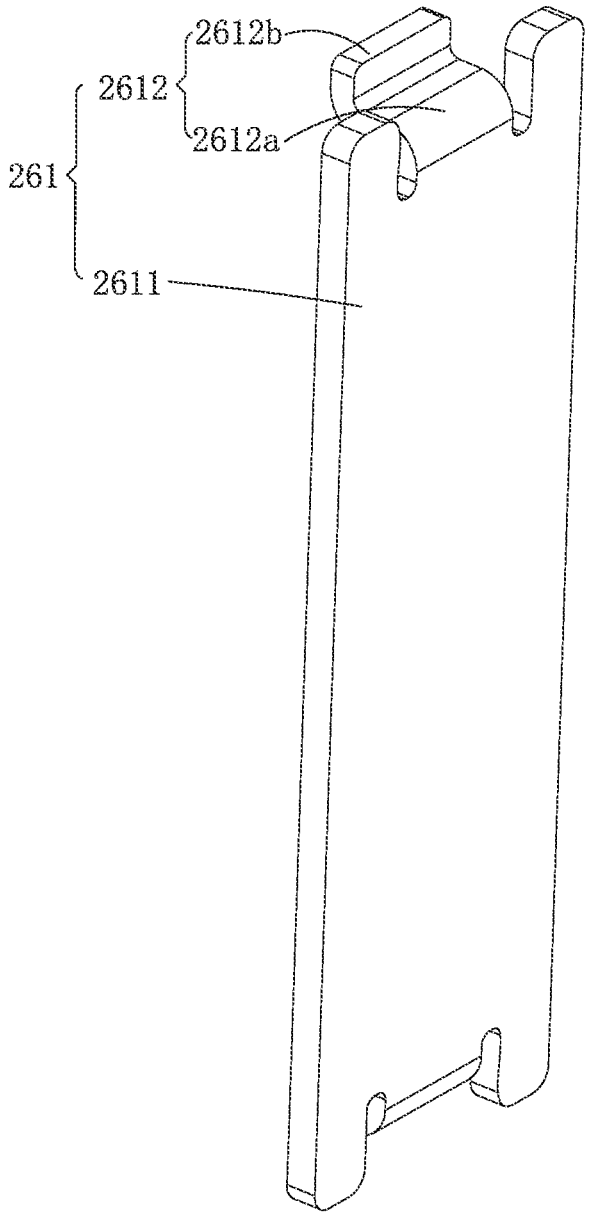
FIG. 6 is an illustrative isometric view of a second lower plate of the multifunctional electromagnetic transducer in the FIG. 1.

In some optional embodiments, referring to FIG. 6, the extension part 2612 includes a third bending part 2612*a* extending from both ends of the main body part 2611 in the second direction, and a third bending part 2612*a* extending in the first direction along the third bending part 2612*a*. The fourth bending part 2612*b* and the fourth bending part 2612*b* are elastically connected to the elastic arm 282 at the same time. More specifically, in some optional embodiments, the third bending part 2612*a* and the fourth bending part 2612*b* have an L-shaped structure as a whole.

In some optional embodiments, the housing 300 includes a first housing 320 and a second housing 330, and the sounding hole 310 is provided on the second housing 330, and the sounding unit 100 abuts against the sounding hole 310, making the sound emitted by the body 100 is diffused and propagated through the sound hole 310. The vibrating unit 200 abuts on a set of opposite sides in the first housing 320. Optionally, an upper cover 160 can be provided at the end of the first housing 320 where the sound film 110 is provided. The sound film is abutted on the second housing 330 through the upper cover 160. Further, the second housing 330 can also be an integral structure with the basin frame of the sound unit 100, or they are just the same part.

In some optional embodiments, a hollow limiting sleeve 290 arranged in an "L" shape is provided on the outside of the vibrating unit 200, and the limiting sleeve 290 is sleeved on the outside of the vibrating unit 200 and connected to the housing 300.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A multifunctional electromagnetic transducer, comprising:

a housing providing with an accommodation space;

a speaker received in the accommodation space, the speaker comprising:

a first vibration system with a voice diaphragm, and a first magnetic circuit system fixed to the housing driving the voice diaphragm to vibrate along a first direction and generate sounds;

a vibrator received in the accommodation space driving the multifunctional electromagnetic transducer to vibrate along a second direction, the vibrator comprising:

a second vibration system with a vibration diaphragm, and a second magnetic circuit system flexible suspending on the housing driving the voice diaphragm to vibrate;

wherein the voice diaphragm, the voice diaphragm and a housing enclosed a rear chamber;

wherein the first magnetic circuit system comprises a first magnetic gap while the first vibration system comprises a first coil located in the magnet gap; a connection support connecting the diaphragm and the first coil, and an elastic diaphragm flexible supporting the first coil; and wherein the connection support comprises a first bending portion, a connection portion bending and extending from the first bending portion along the first direction and, a second bending portion bending and extending from the connection portion along a direction perpendicular to the first direction.

2. The multifunctional electromagnetic transducer as described in claim 1, wherein the vibrator further comprises a flexible support fixed to the housing, while the second magnets circuit system is flexible suspend on the housing by the flexible support.

3. The multifunctional electromagnetic transducer as described in claim 2, wherein the second magnetic circuit system further comprises a second magnetic assembly and a second lower plate supporting the second magnetic assembly, the second lower plate comprises a main portion supporting the second magnetic assembly and an extending portion bending and extending from the main portion to the flexible support, wherein the extending portion is fixed to the flexible support.

4. The multifunctional electromagnetic transducer as described in claim 3, wherein the flexible support comprises a fixing portion fixed to the housing and a flexible arm flexible connecting to the fixing portion which is fixed to the extending portion.

5. The multifunctional electromagnetic transducer as described in claim 4, wherein the extending portion comprises a third bending portion extending from both ends of the main portion to the flexible support and, a fourth bending portion extending from the third bending portion which is fixed to the flexible arm.

6. The multifunctional electromagnetic transducer as described in claim 1, wherein the first magnetic circuit comprises a first main magnet and a plurality of auxiliary magnets arranged on the both sides of the first main magnet, the first main magnet spaced apart from the first main magnet for forming the first magnetic gap, the first magnetic circuit further comprises a first upper plate, a second lower plate and a first magnetic assembly sandwiched between the first upper plate and the second lower plate.

7. The multifunctional electromagnetic transducer as described in claim 1, wherein the first direction forms an angle against the second direction.

8. The multifunctional electromagnetic transducer as described in claim 7, wherein the angle is 0° or 90°.

* * * * *